United States Patent [19]

Bahr et al.

[11] 4,387,119

[45] Jun. 7, 1983

[54] PROCESS FOR GENERATING A SLIDING LAYER ON THE SURFACE OF AN ALUMINUM-COATED RECORD CARRIER

[75] Inventors: Dietrich J. Bahr, Herrenberg; Marian Briska, Böblingen, both of Fed. Rep. of Germany

[73] Assignee: International Business Machines Corporation, Armonk, N.Y.

[21] Appl. No.: 304,279

[22] Filed: Sep. 21, 1981

[30] Foreign Application Priority Data

Oct. 28, 1980 [DE] Fed. Rep. of Germany ..... 3040513

[51] Int. Cl.[3] ..... B05D 1/00

[52] U.S. Cl. ..... 427/209; 427/333; 427/383.1; 427/385.5; 427/404; 427/407.1

[58] Field of Search ..... 427/333, 339, 375, 209, 427/383.1, 385.5, 404, 407.1

*Primary Examiner*—Bernard D. Pianalto

*Attorney, Agent, or Firm*—Joseph G. Walsh

[57] ABSTRACT

For record carrier material, the front and the back sides of which are provided with a lacquer layer and the front side of which is coated with an aluminum layer, one of the two lacquer layers is admixed with a material, such as metal azide, which forms a metal radical suitable for reacting with fatty acids, while at least one of the lacquer layers is admixed with a fatty acid or a mixture of fatty acids.

8 Claims, No Drawings

PROCESS FOR GENERATING A SLIDING LAYER ON THE SURFACE OF AN ALUMINUM-COATED RECORD CARRIER

DESCRIPTION

Technical Field

The present invention concerns a process for generating a sliding layer on the surface of an aluminum layer of a record carrier material to be back-lacquered and arranged on top of a substrate and a lacquer layer.

Background Art

For this purpose, German Patent Application No. P 30 07 331.5, now U.S. Patent Application Ser. No. 06/202,548, proposes a process for at least partially converting aluminum layers into aluminum salts of a fatty acid on an aluminum-coated record carrier, wherein during or after deposition of the aluminum layer, the aluminum, with the vapor of a fatty acid being simultaneously present, is at least partially converted, the degree of conversion being determined by the partial pressure of the fatty acid. It has been proposed in particular to use an oleic acid as a fatty acid, whereby conversion is effected to produce aluminum oleate molecules which are formed on the surface of the layer and which are also deposited therein.

In addition, a process has been proposed for generating a sliding layer on the surface of an aluminum layer of a record carrier material arranged on top of a substrate and a nitrocellulose lacquer layer by the action of one or several fatty acids, wherein prior to the application of the aluminum layer, for coating the back side of the substrate with one or several nitrocellulose lacquer layers, 0.1 to 2 percent by weight of one or several fatty acids is added to the respective last lacquer layer, and wherein f after the material has been aluminum-coated in a vacuum, the record carrier material is then wound up in the form of a roll, and the roll thus produced in subjected to an aging period.

In the case of the above proposed process, it is highly essential that the lacquer layers consist of nitrocellulose lacquers. The sliding layers thus generated are attributable to the formation of an aluminum soap.

It is essential, however, to point out that nitrocellulose lacquers are not particularly suited for such record carriers. This process does not work with other cellulose lacquers, such as acetylcellulose or ethylene cellulose, which are very important because they are much more temperature stable than nitrocellulose lacquers.

As acetylcellulose lacquers are far more important in connection with aluminum-coated record carriers, it was necessary to find a solution which according to present knowledge is suitable for practically all lacquers.

Disclosure of the Invention

Therefore, it is proposed in accordance with the present invention, to add to at least one of the lacquer layers a material forming a metal radical suitable for reacting with fatty acids and to add to at least one of the lacquer layers a fatty acid or a mixture of fatty acids.

The approach preferably adopted is such that a metal azide $Me(N_3)_n$ is used as a material for forming a metal radical. The azide used in in particular one of the group consisting of aluminum, barium, potassium, calcium, lithium and sodium. It is particularly advantageous for a metal azide forming a metal radical to be added to the top-most layer of the lacquer on the back side and for a fatty acid or a mixture of fatty acids to be added to the lacquer on the front side. The proportion of the metal azide should be about 0.1 to 2 percent by weight of the liquid lacquer, whereas the proportion of the fatty acid or the mixture of fatty acids may be about 0.1 to 2. Particularly suitable as a fatty acid is oleic acid. Very good result can also be obtained with a mixture of fatty acids, for example, with tall oil or a mixture of oleic acid, stearic acid and palmitic acid at a ratio of about 3:1:1.

It is particularly advantageous to use the metal azide in stoichiometric excess relative to the oleic acid. The metal radicals required have to be generated from an additional compound, the anion of which in this system is chemically instable and decomposes, leaving a metal radical. For this purpose, it is possible to use, for example, a metal azide $(Me(N_3)_n$ which, in addition to the fatty acid, is added to the lacquer on the back side. As the metal azide decomposes, metal radicals are formed which react with the fatty acid.

In principle there are several approaches. It is possible to add the metal azide to the lacquer on the back side, i.e., to the top-most layer of the lacquer on the back side, whereas the fatty acid or the mixture of fatty acids is added to the lacquer layer on the front side. Another approach is to add the metal azide and the fatty acid or the mixture of fatty acids to the lacquer on the back side. In principle, it is also possible to add the metal azide to the lacquer layer on the front side. But at this stage, this is still difficult because of the caking that is liable to occur in such an arrangement.

As pointed out, the use of the metal azide leads to metal radicals which react with the fatty acid. The reaction is intensified at elevated temperatures. If both materials, i.e., the metal azide and the fatty acid, are contained in the lacquer on the back side, a metal soap is formed therein which diffuses onto the aluminum layer at an elevated temperature of about 70° C. After 12 hours, an efficient, highly hydrophobe soap layer exists. Finely ground $NaN_3$ has been used for the individual tests. This reaction continues until all metal radicals have been used up. By adding other azides, such as $LiN_3$ or $Al(N_3)_3$, other soaps are obtained.

It is much more efficient, however, when one component, say the metal azide, is contained in the lacquer on the back side and the other component, say the fatty acid, is contained in the lacquer layer underneath the aluminum layer. In this case there is a concentration gradient, and the two components diffuse relative to each other; reacting primarily with the aluminum layer.

Further extensive tests have shown that particularly favorable results are obtained with sodium azide. In this case, sodium azide $NaN_3$ with about 1 percent by weight of oleic acid $(CH_3(CH_2)_7CH{=}CH(CH_2)_7COOH)$ is added to the respective lacquers. It is particularly advantageous to use 0.1 percent stearic acid which is added together with the sodium azide. For this purpose, the sodium azide can be treated as an inorganic pigment which is finely dispersed in the lacquer at grain sizes of between 0.1 and 3 $\mu$m. The stearic acid acts in such a manner that lumping of the granular or crystalline sodium azide is avoided.

A further essential aspect of the process in accordance with the invention is that the reaction occurs between solid, rather than liquid and/or gaseous, materials.

Tests carried out under these conditions showed that the best results are obtained at the above-specified percentages if the coated record carrier after its completion, is subjected to an additional heat treatment at about 70° C. for about 12 hours.

As mentioned at the beginning, this process is primarily suitable for acetylcellulose lacquers, but this does not mean that it cannot be used to equal advantage for nitrocellulose lacquers. On the contrary, in the latter case the effect occurring with nitrocellulose lacquers is enhanced still further by the process in accordance with the invention. In addition, none of the material of the very thin aluminum layer is used up, since the metal required for forming the metal soap is obtained from an additional source.

The use of lithium azide, $LiN_3$, and aluminum azide $Al(N_3)_3$ is particularly interesting in this connection. These azides are soluble in an organic solvent and thus can be added to the lacquer, so that a very high degree of dispersion and in some cases even a true solution is obtained. Correspondingly, the metal azide is present in the lacquer in solid solution. The decomposition temperature for both materials is relatively low, so that reaction occurs at a relatively fast rate already at room temperature.

In summary, it can be said that the new process in accordance with the invention permits the generation of sliding layers on the surface of aluminum-coated record carriers with practically all lacquers used for papers thus coated and that in accordance with present knowledge the process constitutes an optimum solution in conjunction with record carrier materials to be printed in electroerosion printers.

What is claimed is:

1. A process for generating a sliding layer on the top surface of an aluminum layer of a record carrier, said record carrier comprising, from top to bottom, an aluminum layer, a first lacquer layer, a substrate, and a second lacquer layer, said process being characterized in that a metal azide in an amount from about 0.1 to about 2% by weight of the lacquer is added to at least one of the lacquer layers, and that a fatty acid or a mixture of fatty acids is added to at least one of the two lacquer layers, and that the finished record carrier material is subjected to a heat treatment at about 70° C. for about 12 hours.

2. A process in accordance with claim 1, characterized in that the azide used belongs to the group consisting of aluminum, barium, potassium, calcium, lithium and sodium azides.

3. A process in accordance with claim 1, characterized in that the proportion of the fatty acid or the mixture of fatty acids is about 0.1 to 2 percent by weight of the liquid lacquer.

4. A process in accordance with claim 3, characterized in that oleic acid is used as the fatty acid.

5. A process in accordance with claim 3, characterized in that tall oil is used as a mixture of fatty acids.

6. A process in accordance with claim 3, characterized in that a mixture of oleic acid, stearic acid and palmitic acid at a ratio of about 3:1:1 is used as a mixture of fatty acids.

7. A process in accordance with claim 1 characterized in that the metal azide is used in a stoichiometric excess relative to the oleic acid.

8. A process in accordance with claim 7, characterized in that sodium azide is used.

* * * * *